US006518697B2

(12) United States Patent
Wassink

(10) Patent No.: US 6,518,697 B2
(45) Date of Patent: Feb. 11, 2003

(54) DISPLAY DEVICE COMPRISING A DEFLECTION UNIT, AND A DEFLECTION UNIT FOR A DISPLAY DEVICE

(75) Inventor: Michiel Harjon Wassink, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 21 days.

(21) Appl. No.: 09/942,000

(22) Filed: Aug. 29, 2001

(65) Prior Publication Data

US 2002/0024288 A1 Feb. 28, 2002

(30) Foreign Application Priority Data

Aug. 29, 2000 (EP) ..... 00203012

(51) Int. Cl.[7] ..... H01J 29/70
(52) U.S. Cl. ..... 313/426; 313/432; 313/439
(58) Field of Search ..... 313/426, 431, 313/432, 439, 440

(56) References Cited

U.S. PATENT DOCUMENTS 4,746,837 A 5/1988 Vink ..... 313/431

*Primary Examiner*—Vip Patel

(57) ABSTRACT

A color display device comprising a cathode ray tube and a deflection unit. The display device includes magnets for correcting distortions in the raster displayed on the screen and means for providing correction currents through the coils of the correction magnets. The correction electromagnets are arranged substantially anti-mirror-symmetrically with respect to the field (vertical, y-z) deflection plane, substantially mirror-symmetrically with respect to the line (horizontal, x-z) deflection plane, and each correction coil extends along an arc portion between angles $\alpha_1$ and $\alpha_2$, said angles obeying the following rules:

$$|\cos(3\alpha_1)-\cos(3\alpha_2)|\geqq 1.33$$

and $$|\cos(5\alpha_1)-\cos(5\alpha_2)|\leqq 0.5,$$

$\alpha_1$ and $\alpha_2$ being taken with respect to the line (horizontal) deflection plane.

4 Claims, 5 Drawing Sheets

DISPLAY DEVICE COMPRISING A DEFLECTION UNIT, AND A DEFLECTION UNIT FOR A DISPLAY DEVICE

BACKGROUND OF THE INVENTION

The invention relates to a colour display device comprising a cathode ray tube having a display screen, a means for generating at least one electron beam and a deflection unit for generating deflection fields for deflecting electron beam (s) across the display screen in two perpendicular directions, and having magnetic field-generating means at or near a display screen-facing end of the deflection unit for generating an electromagnetic field to reduce raster distortions.

The invention also relates to a deflection unit for a cathode ray tube.

A colour display device and a deflection unit as described above are known from U.S. Pat. No. 4,746,837.

The known display device comprises a number of pole shoes arranged around the defection unit and at the side of the deflection unit facing the display screen. A pin-cushion shaped distortion of the deflection field is formed between the pole shoes. Said pin-cushion distortion necessitates a raster correction.

Although the known devices and similar devices in which magnetic correction fields are provided substantially reduce raster errors especially in the corners of the display screen, remaining raster errors are still noticeable.

It is an object of the invention to provide a display device and/or a deflection unit for a display device in which improved raster corrections are obtainable.

To this end, in accordance with an aspect of the invention, the display device is characterized in that the magnetic field-generating means comprise correction electromagnets, said correction electromagnets extending along an arc portion between angles $\alpha_1$ and $\alpha_2$, said angles obeying the following rules:

$$|\cos(3\alpha_1)-\cos(3\alpha_2)|\geqq 1.33$$

and $$|\cos(5\alpha_1)-\cos(5\alpha_2)|\leqq 0.5,$$

$\alpha_1$ and $\alpha_2$ being taken with respect to the line (horizontal) deflection plane, and the display device comprising means for driving the electromagnets, the electromagnets and the means being arranged to generate a correction field that is substantially mirror-symmetrical with respect to the line (horizontal) deflection plane, and substantially anti-mirror-symmetrical with respect to the field (vertical) deflection plane.

Correction magnets which extend through angles obeying the above rules generate a relatively strong six-pole field (to compensate raster distortions), i.e. at least ⅔ of the maximum, while generating a relatively small ten-pole field, i.e. less than 25% of the maximum ten-pole field. Such ten-pole fields may in themselves be a cause of distortions.

Each electromagnet preferably comprises a coil wound around a core, the coils being driven in operation by a current at the same ground frequency as the line deflection coils.

Several preferred sub-ranges exist within the indicated range for $\alpha_1$ and $\alpha_2$.

The first of such a preferred sub-range is given by the condition:

$$|\cos(7\alpha_1)-\cos(7\alpha_2)|\leqq 0.67$$

Within this range, the correction coils generate a relatively small 14-pole field (less than ⅓ of the maximum value). A somewhat larger range (up to ⅓ of the maximum) is possible since, in general, 14-pole fields are less strong than 10-pole fields.

A further preferred sub-range is given by $$|\cos(9\alpha_1)-\cos(9\alpha_2)|\geqq 0.67$$

Within this sub-range, 18-pole fields are less than ⅓ of the maximum.

BRIEF DESCRIPTION OF THE DRAWINGS

These and further aspects of the invention will be explained in greater detail by way of example and with reference to the accompanying drawings, in which.

The Figures are not drawn to scale. In general, like reference numerals refer to like parts.

DETAILED DESCRIPTION OF PREFERRED EMBODIMENTS

Figure 1:
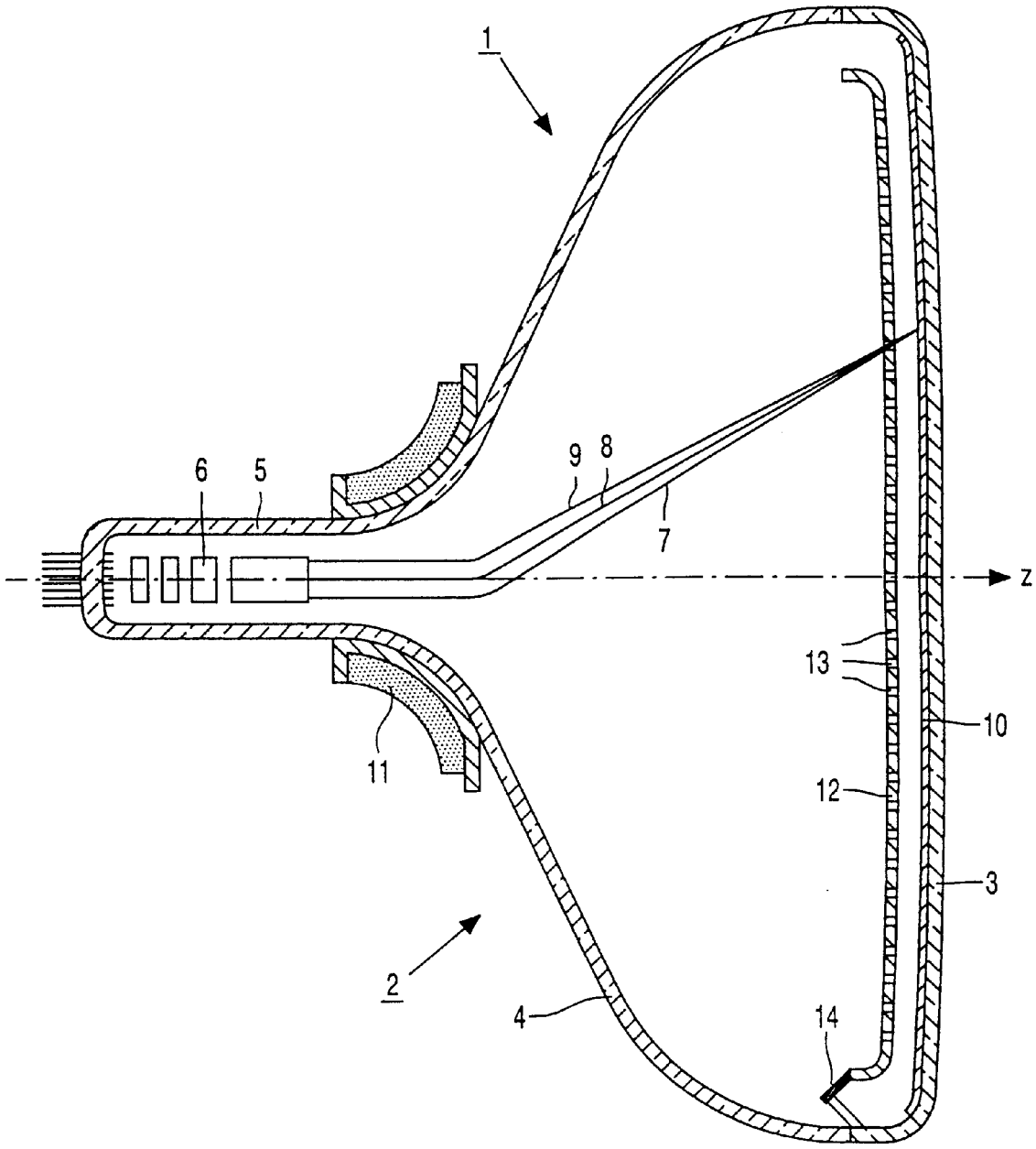
FIG. 1 is a display device.

A colour display device 1 (FIG. 1) includes an evacuated envelope 2 comprising a display window 3, a cone portion 4 and a neck 5. Said neck 5 accomodates an electron gun 6 for generating three electron beams 7, 8 and 9. A display screen 10 is present on the inner side of the display window. Said display screen 10 comprises a phosphor pattern of phosphor elements luminescing in red, green and blue. On their way to the display screen, the electron beams 7, 8 and 9 are deflected across the display screen 10 by means of a deflection unit 11 and pass through a shadow mask 12 which is arranged in front of the display window 3 and comprises a thin plate having apertures 13. The shadow mask is suspended in the display window by means of suspension means 14. The three electron beams converge on the display screen. They pass through the apertures of the shadow mask at a small angle with respect to each other and, consequently, each electron beam impinges on phosphor elements of only one colour. In FIG. 1, the axis (z-axis) of the envelope is also indicated.

Figure 2:
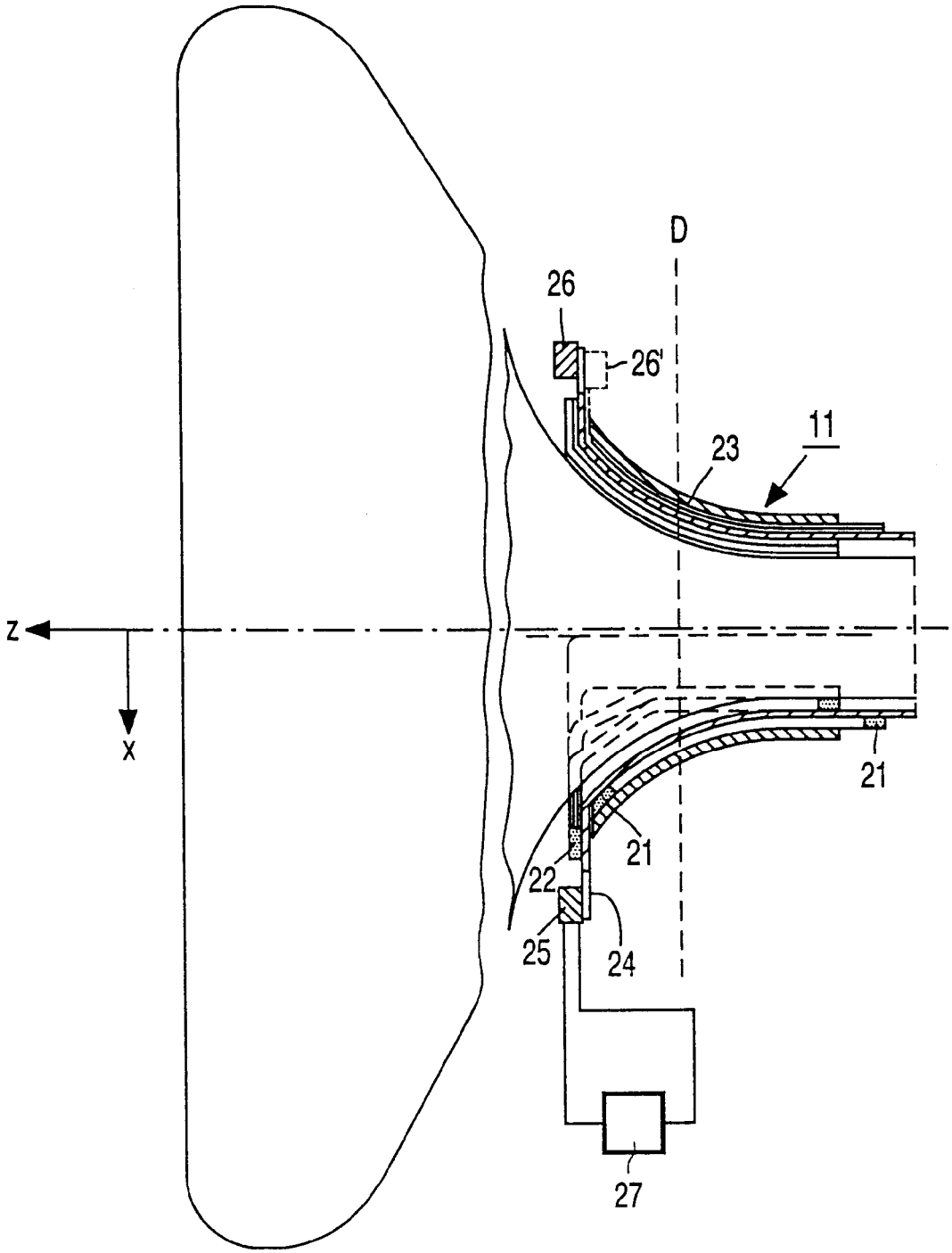
FIG. 2 is a sectional view of a deflection unit comprising compensation coils
Figure 3:
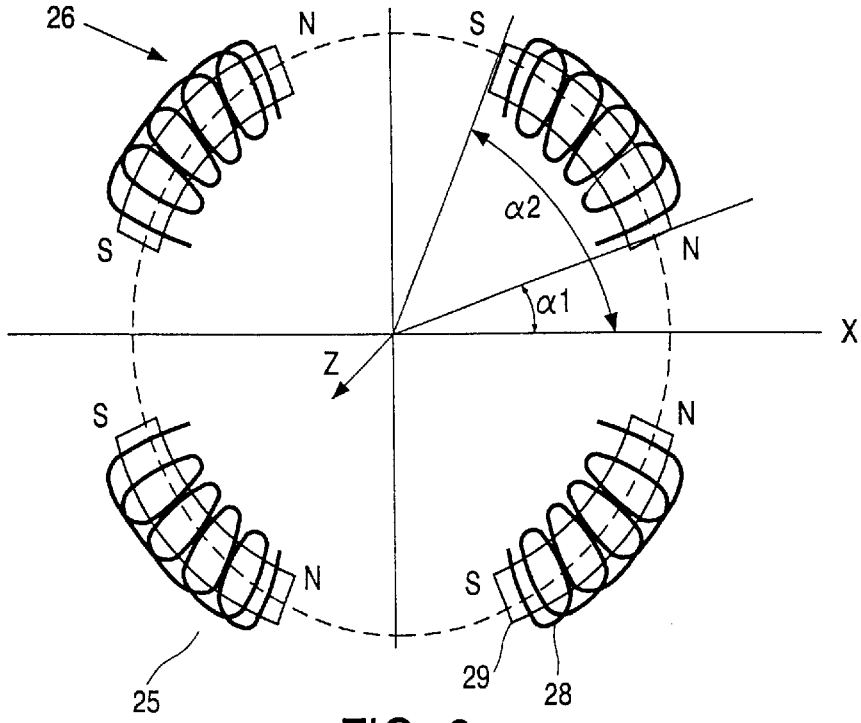
FIG. 3 is a schematic front view of a set of compensation coils.

FIG. 2 is a sectional view of a deflection unit in accordance with the invention. Said deflection unit comprises two deflection coil systems 21 and 22 for deflecting the electron beams in two mutually perpendicular directions. Coil system 21 comprises coils for the field deflection (deflection at a relatively low frequency, which is the vertical direction in standard devices) of the electron beams. In this example, the deflection unit further comprises a yoke 23. Said yoke is made of a soft-magnetic material. Correction electromagnets 25, 26 are arranged around the display device, in this example on the deflection unit 11 at or near the side of the deflection unit (the flaring end) that faces the display screen. The correction magnets 26 could be fitted into a holder 24 or directly on the deflection unit. They could be fitted on a frontal surface of holder 24 (i.e. a surface facing the display screen) or on a rearward facing surface (as shown in FIG. 2 by correction coils 26'). Means 27 are provided to supply the coils 28 wound around cores 29 of electromagnets 25, 26 in operation with a current having the same frequency as the field (vertical) deflection current through coils 21. FIG. 3 schematically shows how the electromagnets 25, 26 extend. They are substantially anti-mirror symmetrically arranged with respect to the vertical deflection plane (the y-z plane), i.e. when viewed on both sides of the y-z plane, a North pole faces a South pole and vice-versa, and substantially mirror-symmetrically with respect to the horizontal deflection plane, i.e. on both sides of the x-z plane, like poles face each other (North facing North and South facing South). In this embodiment, each electromagnet comprises a coil wound around a core. In this embodiment, the end of the cores is substantially located at angles $\alpha_1$ and $\alpha_2$ with respect to the horizontal (line) deflection plane. The advantage of arranging the compensation coils at or near the flaring end (i.e. the end of the deflection unit facing the display screen) of the deflection unit is that multipole fields can be achieved that cannot be to achieved by frame coil winding alone. The most important multipole contribution is a positive six-pole.

Due to the symmetry of the arrangement of the compensation coils, only six-pole, 10-pole, 14-pole, etc. field components are caused by the compensation coils. The inventors have found that the strength of these contributions can be calculated or estimated in a first order approximation to be proportional to (for the six-pole component) $\cos(3\alpha_1)-\cos(3\alpha_2)$ (for the 10-pole component) $\cos(5\alpha_1)-\cos(5\alpha_2)$ (for the 14-pole component) $\cos(7\alpha_1)-\cos(7\alpha_2)$ (for the 18-pole component) $\cos(9\alpha_1)-\cos(9\alpha_2)$ etc.

The most important field components to be introduced by the compensation coils is a six-pole field at or near the flared end of the deflection unit. Such a six-pole component reduces both NS (North-South) and EW (East-West) pincushion distortion.

Figure 4:
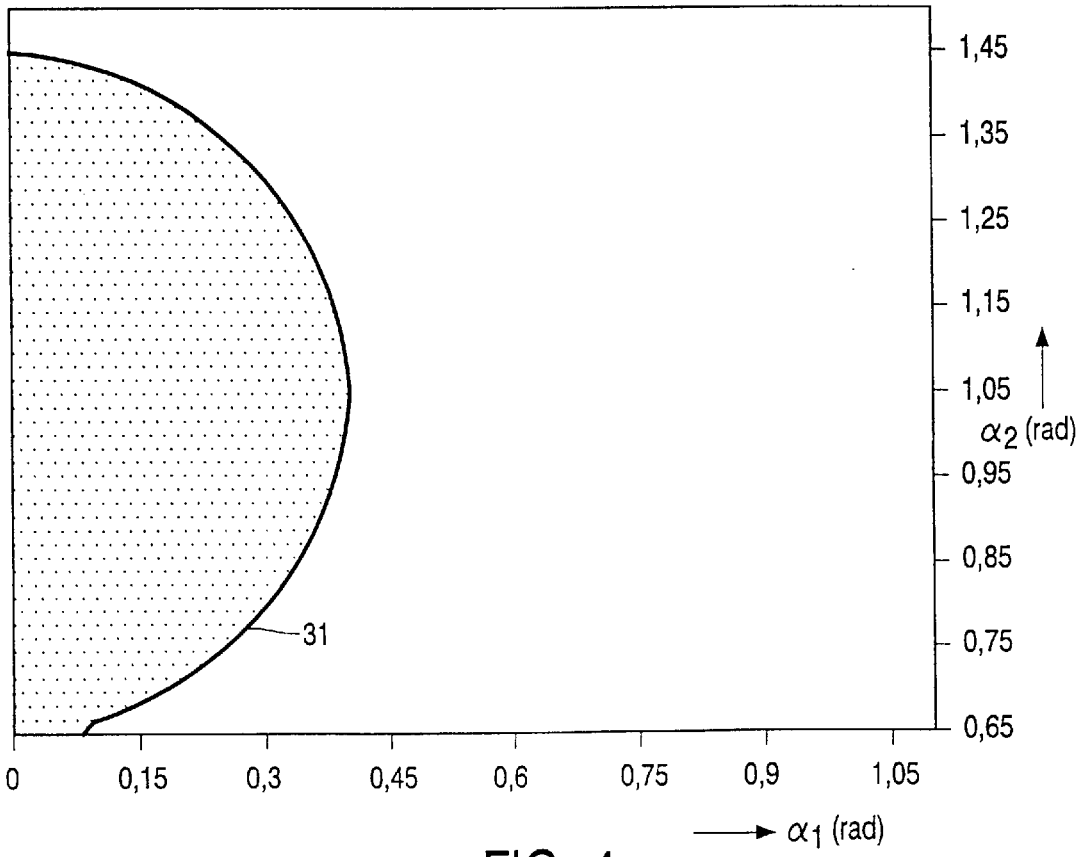
FIG. 4 graphically depicts the angles $\alpha_1$ and $\alpha_2$ for which it holds that $|\cos(3\alpha_1)-\cos(3\alpha_2)|\geqq 1.33$.

FIG. 4 depicts the region in which the absolute value of $\cos(3\alpha_1)-\cos(3\alpha_2)$ is at least 1.33, i.e. ⅔ of the maximum value. $\alpha_1$ is plotted on the horizontal axis (in radials, one radial being 57.3 degrees) and $\alpha_2$ is plotted on the vertical axis. The region in which $|\cos(3\alpha_1)-\cos(3\alpha_2)| \geqq 1.33$ is indicated in grey, i.e. the more or less half circular area near the left-hand side of the Figure, is delimited by line 31.

However, the compensation coils also generate higher multi-pole components, such as 10-pole, 14-pole, etc. components. Preferably, these components are small because they may themselves be the cause of distortions.

Figure 5:
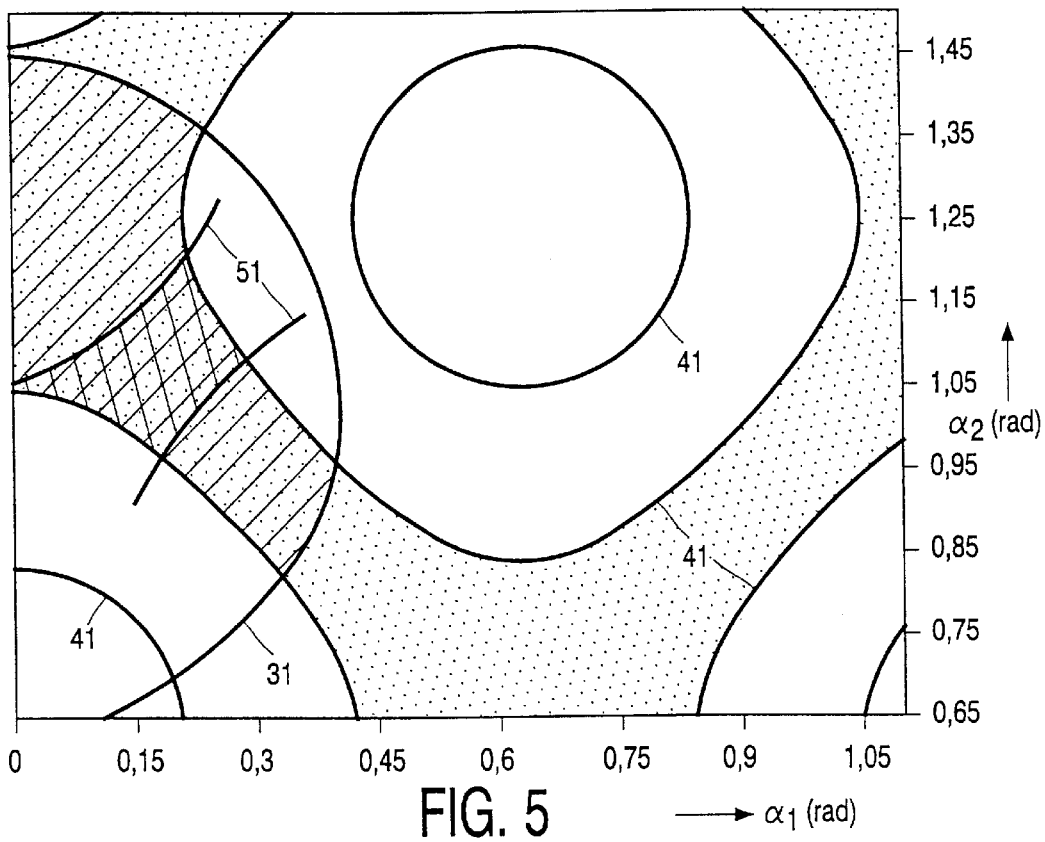
FIG. 5 graphically depicts the angles $\alpha_1$ and $\alpha_2$ for which it holds that $|\cos(3\alpha_1)-\cos(3\alpha_2)|\geqq 1.33$ and $|\cos(5\alpha_1)-\cos(5\alpha_2)|\leqq 0.5$.

FIG. 5 schematically shows the strength of the most important one of these higher order components (the 10-pole component) as a function of the angles $\alpha_1$ (horizontal axis) and $\alpha_2$ (vertical axis). The grey area (delimited by lines 40) represents those values for $\alpha_1$ and $\alpha_2$ for which the value of the 10-pole component is less than 25% of the maximum value. Lines 41 delimit values for which the value is 75% or more of the maximum value. Line 31 (see FIG. 4) is also shown in FIG. 5. The grey area within line 31 shows graphically those values of $\alpha_1$ and $\alpha_2$ that lie within the scope of the independent claim. Lines 51 delimit graphically a preferred embodiment of the invention, namely embodiments in which the 14-pole component is small, namely less than ⅓ of the maximum value.

Figure 6:
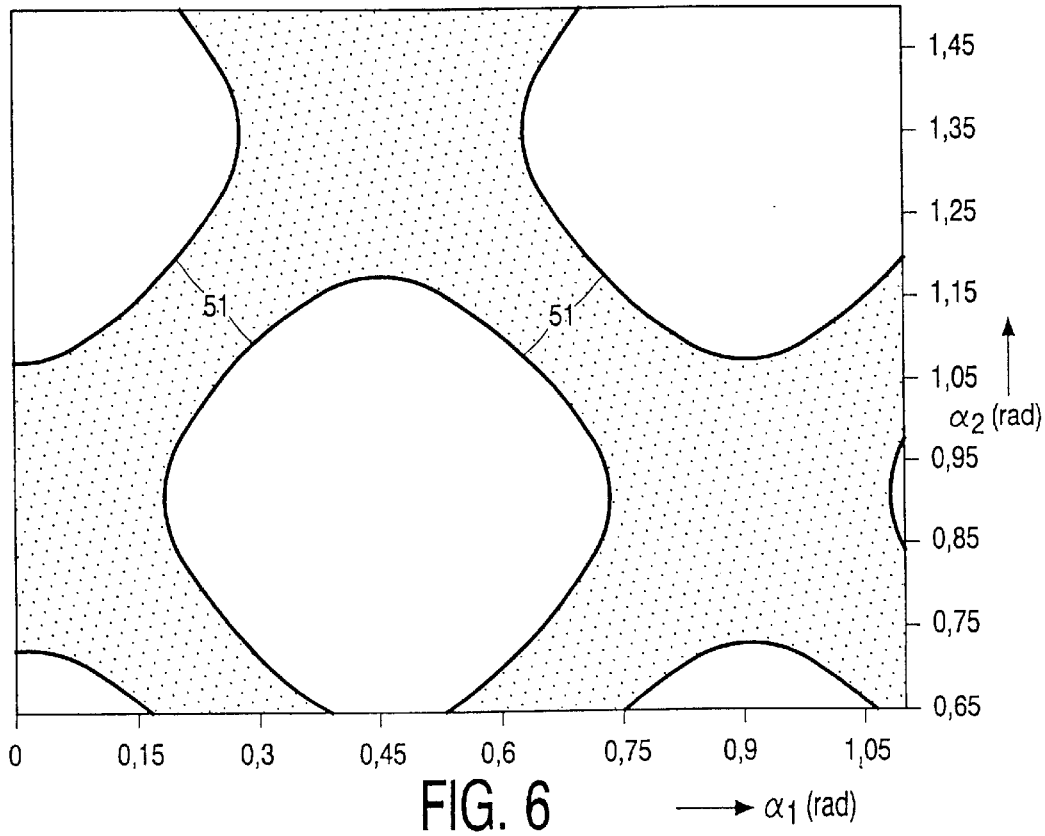
FIG. 6 graphically depicts the angles $\alpha_1$ and $\alpha_2$ for which it holds that $|\cos(7\alpha_1)-\cos(7\alpha_2)|\leqq 0.67$.

FIG. 6 shows graphically (within the grey area delimited by lines 51) the values for $\alpha_1$ and $\alpha_2$ for which the 14-pole component is small, namely less than ⅓ of the maximum value.

Figure 7:
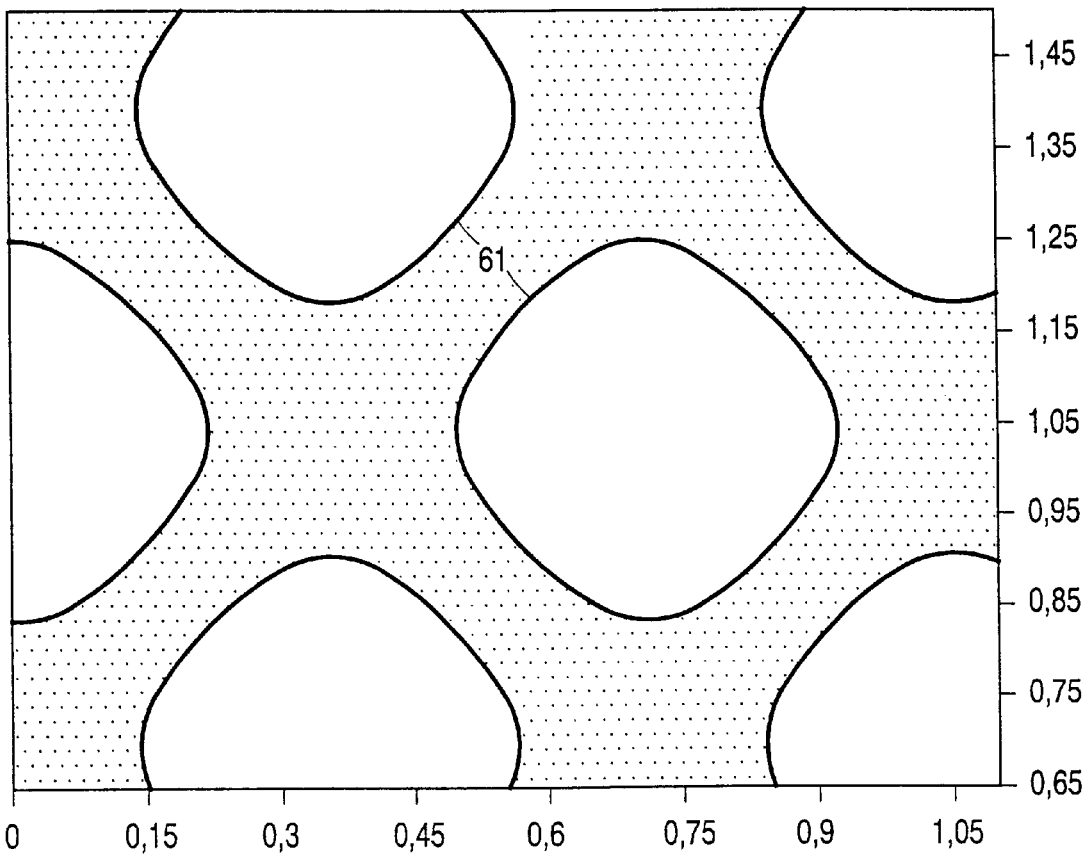
FIG. 7 graphically depicts the angles $\alpha_1$ and $\alpha_2$ for which it holds that $|\cos(9\alpha_1)-\cos(9\alpha_2)|\leqq 0.67$.

Finally, FIG. 7 shows graphically (within the grey area delimited by lines 61) the values for $\alpha_1$ and $\alpha_2$ for which the 20-pole component is small, namely less than ⅓ of the maximum value.

It will be clear that, within the scope of the invention, many more variations are possible to those skilled in the art.

It is to be understood that (as is more or less standard) in a device in accordance with the invention the electron beam or beams are deflected in two mutually transverse directions, which are called the field and line directions. Within the scope of the above description it is assumed that the field deflection (relatively low frequency) takes place in the vertical direction, and the line deflection (the relatively fast frequency) takes place in the horizontal direction, the horizontal direction corresponding to the long axis of the rectangular display screen, and the vertical direction corresponding to the short axis of the rectangular display screen. The words 'horizontal' and 'vertical' are not to be considered as limiting the scope of the invention. The planes of (anti)-symmetry are given by the direction of the field (low frequency) and line (high frequency) deflections. The words 'horizontal' and 'vertical' are mentioned for easier understanding of the invention with respect to standard display devices. There are, however, display devices in which the rectangular display screen is oriented with its long axis in the vertical direction and the field and line deflection still being along the vertical and horizontal direction, respectively. There are, however, also display devices (of the so-called transposed scanning type) in which the high-frequency deflection takes place along the vertical direction and the low-frequency deflection along the horizontal direction.

The embodiments described above illustrate the invention with reference to a three-electron beam in-line cathode ray tube. Although the invention is of particular importance for such types of cathode ray tubes because of the importance of obtaining a properly aligned raster, in particular for 'super-flat' or 'real-flat' tubes, the invention may also be used for cathode ray tubes in which a single electron beam-generating electron gun is used, for instance in index tubes. In index tubes, the electron beam is scanned across the display screen and the device has means for tracking and steering the path of the electron beam across the display screen. Although the path of the electron beam can be adjusted, it is of great importance to minimise the adjustment needed. On average, the less adjustment is needed, the greater the image quality. As the present invention improves the raster, the need for adjustment decreases, thus improving the image quality.

What is claimed is:

1. A colour display device (1) comprising a cathode ray tube having a display screen (3), a means for generating at least one electron beam (6) and a deflection unit (11) for generating deflection fields for deflecting electron beam(s)

(7, 8, 9) across the display screen (3) in two perpendicular directions (x, y), and having magnetic field-generating means (26, 25) at or near a display screen-facing end of the deflection unit for generating an electromagnetic field to reduce raster distortions, characterized in that the magnetic field-generating means (25, 26) comprise correction electromagnets (25, 26), said correction electromagnets extending along an arc portion between angles $\alpha_1$ and $\alpha_2$, said angles obeying the following rules:

$$|\cos(3\alpha_1)-\cos(3\alpha_2)|\geqq 1.33$$

and $$|\cos(5\alpha_1)-\cos(5\alpha_2)|\leqq 0.5,$$

$\alpha_1$ and $\alpha_2$ being taken with respect to the line (horizontal, x-z) deflection plane, and the display device comprising means (27) for driving the electromagnets (25, 26), the electromagnets (25, 26) and the means (27) being arranged to generate a correction field that is substantially mirror-symmetrical with respect to the line (horizontal, x-z) deflection plane, and substantially anti-mirror-symmetrical with respect to the field (vertical, y-z) deflection plane.

2. A colour display device as claimed in claim 1, characterised in that the following condition holds:

$$|\cos(7\alpha_1)-\cos(7\alpha_2)|\leqq 0.67.$$

3. A colour display device as claimed in claim 1, characterised in that the following condition holds:

$$|\cos(9\alpha_1)-\cos(9\alpha_2)|\leqq 0.67.$$

4. A deflection unit for a cathode ray tube having magnetic field-generating means (26, 25) at or near a display screen-facing end of the deflection unit for generating a magnetic field to reduce raster distortions, characterised in that the magnetic field-generating means comprise correction electromagnets (25, 26) arranged to generate a magnetic field substantially anti-mirror-symmetrically with respect to the field (vertical, y-z) deflection plane, substantially mirror-symmetrically with respect to the line (horizontal, x,z) deflection plane, and each correction coil extends along an arc portion between angles $\alpha_1$ and $\alpha_2$, said angles obeying the following rules:

$$|\cos(3\alpha_1)-\cos(3\alpha_2)|\geqq 1.33$$

and $$|\cos(5\alpha_1)-\cos(5\alpha_2)|\leqq 0.5,$$

$\alpha_1$ and $\alpha_2$ being taken with respect to the line (horizontal) deflection plane.

* * * * *